US012061008B2

(12) United States Patent
Costello et al.

(10) Patent No.: US 12,061,008 B2
(45) Date of Patent: Aug. 13, 2024

(54) AIR DIFFUSER

(71) Applicant: Johnson Controls Technology Company, Auburn Hills, MI (US)

(72) Inventors: Mark J. Costello, Plano, TX (US); David G. Pich, Frisco, TX (US); Ryan M. Perkinson, Plano, TX (US); Ernest Freeman, Little Elm, TX (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 802 days.

(21) Appl. No.: 17/127,191

(22) Filed: Dec. 18, 2020

(65) Prior Publication Data

US 2021/0222907 A1 Jul. 22, 2021

Related U.S. Application Data

(63) Continuation of application No. 15/345,030, filed on Nov. 7, 2016, now Pat. No. 10,871,304.

(51) Int. Cl.
*F24F 13/06* (2006.01)
*F24F 13/26* (2006.01)

(52) U.S. Cl.
CPC ..... *F24F 13/06* (2013.01); *F24F 13/26* (2013.01); *F24F 2013/0612* (2013.01); *F24F 2221/14* (2013.01)

(58) Field of Classification Search
CPC .... F24F 14/06; F24F 14/26; F24F 2013/0612; F24F 2221/14
USPC ..... 454/292
See application file for complete search history.

(56) References Cited

U.S. PATENT DOCUMENTS

| | | | |
|---|---|---|---|
| 2,781,715 | A | 2/1957 | Labus |
| 2,791,170 | A | 5/1957 | Phillips et al. |
| 3,677,164 | A | 7/1972 | Traver et al. |
| 4,130,132 | A | 12/1978 | Cote |
| 4,259,898 | A | 4/1981 | Finkelstein et al. |
| 4,303,007 | A | 12/1981 | Riegel et al. |
| 4,506,830 | A | 3/1985 | Francel |
| 4,508,022 | A | 4/1985 | Finkelstein et al. |
| 4,876,949 | A | 10/1989 | Fairchild et al. |
| 5,033,361 | A | 7/1991 | Moszkowski |
| 5,058,490 | A | 10/1991 | Sodec et al. |
| 5,069,114 | A | 12/1991 | Sodec et al. |
| 5,318,474 | A | 6/1994 | Klassen et al. |
| 5,807,171 | A | 9/1998 | Felsen |

(Continued)

OTHER PUBLICATIONS

Ceiling Diffusers, Price Industries Limited, 2014, https://www.priceindustries.com/content/uploads/assets/literature/catalogs/complete-sections/section%20a/section-c---ceiling-diffusers.pdf.

*Primary Examiner* — Avinash A Savani
*Assistant Examiner* — Dana K Tighe
(74) *Attorney, Agent, or Firm* — Fletcher Yoder, PC

(57) ABSTRACT

Embodiments of the present disclosure are directed toward an air diffuser that includes a mounting plate having an opening in a center portion of the mounting plate, where the opening is configured to be coupled to ductwork, a low flow adapter coupled to the mounting plate and disposed over the opening, where the low flow adapter includes extruded nozzles configured to increase a velocity and induction of air flow directed toward an interior space, and where the extruded nozzles are disposed at an angle with respect to a horizontal plane defined by the center portion of the mounting plate, and a diffusion plate coupled to the mounting plate, such that the low flow adapter is positioned between the mounting plate and the diffusion plate.

20 Claims, 5 Drawing Sheets

(56) References Cited

U.S. PATENT DOCUMENTS

| | | | |
|---|---|---|---|
| 6,083,100 | A | 7/2000 | Hardy et al. |
| 6,135,878 | A | 10/2000 | Felsen |
| 6,176,777 | B1 | 1/2001 | Smith et al. |
| 6,231,438 | B1 | 5/2001 | Laudermilk |
| 7,241,217 | B2 | 7/2007 | Demster |
| 7,641,125 | B2 | 1/2010 | Rimmer et al. |
| 7,645,188 | B1 | 1/2010 | Peerbolt |
| 7,841,930 | B2 | 11/2010 | Rimmer et al. |
| 8,564,924 | B1 | 10/2013 | Waddell et al. |
| 9,291,177 | B2 | 3/2016 | Wurz et al. |
| 2010/0317277 | A1 | 12/2010 | Raible et al. |
| 2012/0190293 | A1 | 7/2012 | Badenhorst |

AIR DIFFUSER

CROSS-REFERENCE TO RELATED APPLICATION

This application is a continuation of U.S. patent application Ser. No. 15/345,030, entitled "AIR DIFFUSER," filed Nov. 7, 2016, which is hereby incorporated by reference in its entirety for all purposes.

BACKGROUND present disclosure relates generally to ventilation, heating and/or cooling systems, and more particularly, to an air diffuser for a ventilation, heating and/or cooling system.

Air diffusers may be utilized to distribute air from a duct into an interior space such as a room, office, and/or other space of a building. Typically, air diffusers are mounted to a ceiling, wall, and/or floor of the interior space. Additionally, air diffusers may be coupled to an outlet of the duct that is configured to transfer conditioned air from an air handler or ventilation air from a dedicated outdoor air system (DOAS) to the interior space. Unfortunately, air diffusers do not provide significant dispersion of conditioned air when the conditioned air flowing through the duct is at a relatively low flow, and/or volume.

SUMMARY

The present disclosure relates to an air diffuser that includes a mounting plate having an opening in a center portion of the mounting plate, where the opening is configured to be coupled to ductwork, a low flow adapter coupled to the mounting plate and disposed over the opening, where the low flow adapter includes extruded nozzles configured to increase a velocity and induction of air flow directed toward an interior space, and where the extruded nozzles are disposed at an angle with respect to a horizontal plane defined by the center portion of the mounting plate, and a diffusion plate coupled to the mounting plate, such that the low flow adapter is positioned between the mounting plate and the diffusion plate.

The present disclosure also relates to a system that includes an air handler configured to place air in a heat exchange relationship with a refrigerant, ductwork coupled to the air handler and configured to direct the air from the air handler to one or more interior spaces, and an air diffuser coupled to the ductwork. The air diffuser includes a mounting plate having an opening in a center portion of the mounting plate, a low flow adapter coupled to the mounting plate and disposed over the opening, where the low flow adapter comprises extruded nozzles configured to increase a velocity of air flow directed toward the one or more interior spaces, and where the extruded nozzles are disposed at an angle with respect to a horizontal plane defined by the center portion of the mounting plate.

The present disclosure further relates to a low flow adapter for an air diffuser that includes edges configured to be coupled to a mounting plate of the air diffuser, such that the low flow adapter is disposed over an opening of the air diffuser, sloped faces extending from the edges, where the sloped faces include extruded nozzles configured to increase a velocity of air flow directed toward an interior space, and where the extruded nozzles are disposed at an angle with respect to a horizontal plane defined by the mounting plate, and a base plate coupled to the sloped faces and configured to form a chamber, such that all or a portion of the air flow is directed through the extruded nozzles.

DRAWINGS

DETAILED DESCRIPTION

Embodiments of the present disclosure are directed towards an enhanced air diffuser that is configured to provide increased dispersion of conditioned air into an interior space even when the conditioned air is supplied at low flow rates, and/or low volumes. Specifically, a low flow adapter may be included in an air diffuser to enhance an amount of diffusion of the conditioned air into the interior space. For example, the low flow adapter may include a plurality of extruded nozzles that increase a velocity of the conditioned air flowing from ductwork into the interior space (e.g., an environment to be heated and/or cooled by the conditioned air or ventilated by a dedicated outdoor air system (DOAS)). The increased velocity of the conditioned air may enhance diffusion of the conditioned air even when the conditioned air is flowing through the ductwork at relatively low flow rates, and/or low volumes. Further, the extruded nozzles may be angled toward an opening in the air diffuser to reduce obstructions to the flow of conditioned air caused by the ductwork and/or other components of the air diffuser. Embodiments of the present disclosure provide increased dispersion of heating and/or cooling and/or ventilation to the interior space when conditioned air flowing through the ductwork is at a relatively low flow rate, and/or low volume. Increased dispersion may be accomplished by an increase in velocity due to formation of vena contracta (e.g., the reduction in area of the air jet just beyond the nozzle outlets which results in an increase of jet velocity). The increased velocity creates an increased length of air pattern throw.

Figure 1:
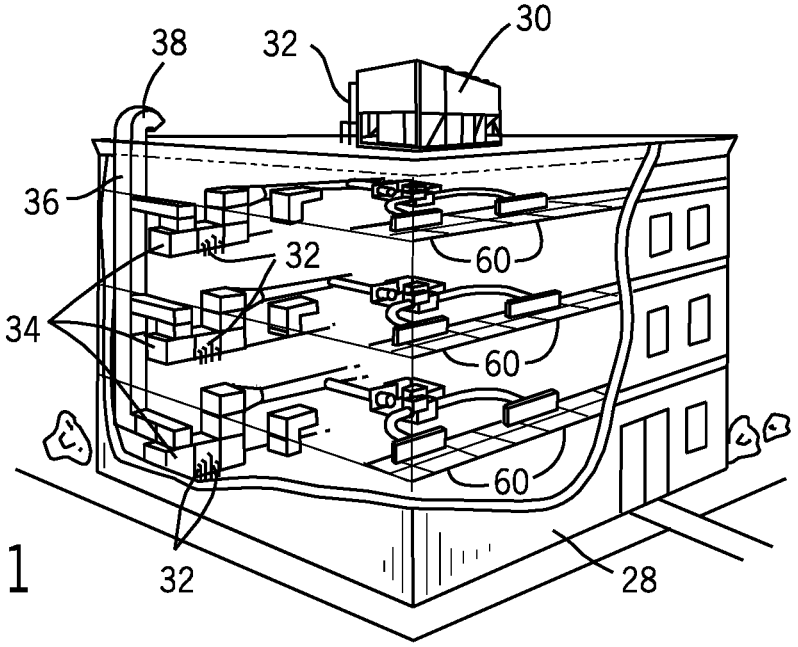
FIG. 1 is a perspective view of a commercial or industrial system using a heat exchanger and air handlers to cool and/or a dedicated outdoor air system (DOAS) to ventilate a building, in accordance with an embodiment of the present disclosure.

Turning now to the drawings, FIG. 1 illustrates an application of the presently disclosed embodiments, in this case air diffusers that may enhance an efficiency of an HVAC&R system for building environmental management. A building 28 may be heated and/or cooled and/or ventilated by a system that includes a chiller 30, which is typically disposed on or near the building 28, or in an equipment room or basement. The chiller 30 may be an air-cooled device that implements a refrigeration cycle to cool water, for example.

The water (e.g., refrigerant) may then be circulated to the building 28 through water conduits 32. The water conduits 32 may route the water to air handlers or DOAS 34 at individual floors or sections of the building 28. The air handlers or DOAS 34 may also be coupled to ductwork 36 adapted to blow air from an outside intake 38.

The chiller 30, which may include heat exchangers for both evaporating and condensing a refrigerant, may cool water (e.g., refrigerant) that is circulated to the air handlers or DOAS 34. Air blown over additional coils that receive the water in the air handlers or DOAS 34 may cause the water to increase in temperature and the circulated air to decrease in temperature. The conditioned air is then routed to various locations (e.g., interior spaces) in the building 28 via additional ductwork. Ultimately, distribution of the conditioned air is routed to the air diffusers that deliver the conditioned air to offices, apartments, hallways, and any other interior spaces within the building 28. In many applications, thermostats or other command devices (not shown in FIG. 3) will serve to control the flow of conditioned air and/or ventilation air through and from the individual air handlers or DOAS 34 and ductwork 36 to maintain desired temperatures and/or ventilation at various locations in the building 28.

Figure 2:
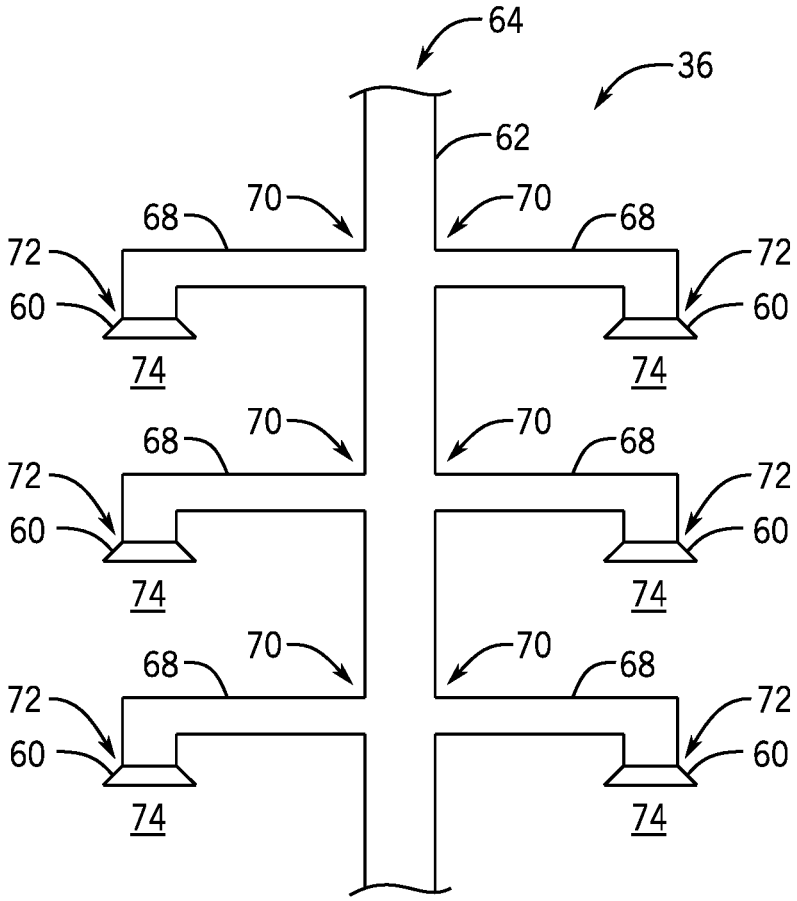
FIG. 2 is a schematic of a ductwork assembly that may direct conditioned air to one or more air diffusers, in accordance with an embodiment of the present disclosure.

FIG. 2 is a schematic of the ductwork 36 that may be utilized to deliver conditioned air or ventilation to one or more air diffusers 60. As shown in the illustrated embodiment of FIG. 2, the ductwork 36 may include a primary duct 62, which may be fluidly coupled with an output of one or more of the air handlers or DOAS 34 at a first end 64. Accordingly, the primary duct 62 may direct conditioned air or ventilation from the one or more air handlers or DOAS 34 toward the one or more air diffusers 60. In some embodiments, a second end 66 of the primary duct 62 may be positioned at or near one or more lowermost interior spaces (e.g., first floor) along the primary duct 62 (e.g., when the primary duct 62 extends vertically along multiple floors of the building 28). In other embodiments, the second end 66 may be positioned at or near one or more interior spaces furthest from the first end 64 of the primary duct 62 (e.g., when the primary duct 62 extends along a single floor of the building 28). In still further embodiments, the second end 66 may be positioned at any suitable location within or external to the building 28. Additionally, the ductwork 36 may include one or more secondary ducts 68. The secondary ducts 68 may be configured to direct conditioned air from the primary duct 62 to the air diffusers 60. Therefore, a first end 70 of each of the secondary ducts 68 may be fluidly coupled to the primary duct 62 and a second end 72 of each of the secondary ducts 68 may be fluidly coupled to a respective air diffuser 60.

Each air diffuser 60 may be configured to disperse conditioned air or ventilation into a respective interior space 74, thereby providing heating, cooling, and/or ventilation to the interior space 74. However, in some cases, a flow rate and/or volume of the conditioned air or ventilation flowing from the one or more air handlers or DOAS 34 (and thus the primary duct 62) may fluctuate. For example, a flow rate and/or volume of the conditioned air or ventilation from the one or more air handlers or DOAS 34 may be relatively low. Dispersion of the conditioned air or ventilation into the interior spaces 74 may decrease as the flow rate of the conditioned air or ventilation through typical air diffusers decreases. In some cases, typical air diffusers may not distribute the desired amount of heating and/or cooling and/or ventilation to the interior space 74 (e.g., an amount of heating and/or cooling to reach a set point of a thermostat or an amount of ventilation to satisfy $CO_2$ sensor) when the flow rate and/or volume of the conditioned air or ventilation falls below a threshold (e.g., below 50 cubic feet per minute (cfm), below 40 cfm, below 30 cfm, or below 25 cfm). Accordingly, embodiments of the air diffusers 60 disclosed herein may increase dispersion of the conditioned air or ventilation into the interior space 74 even at flow rates and/or volumes of the conditioned air below the threshold. Thus, interior spaces 74 of the building 28 may be heated and/or cooled to a desired temperature (e.g., set point determined by the thermostat) or ventilated to maintain desired $CO_2$ levels as read by a $CO_2$ meter even at low flow rates and/or volumes of the conditioned air.

Figure 3:
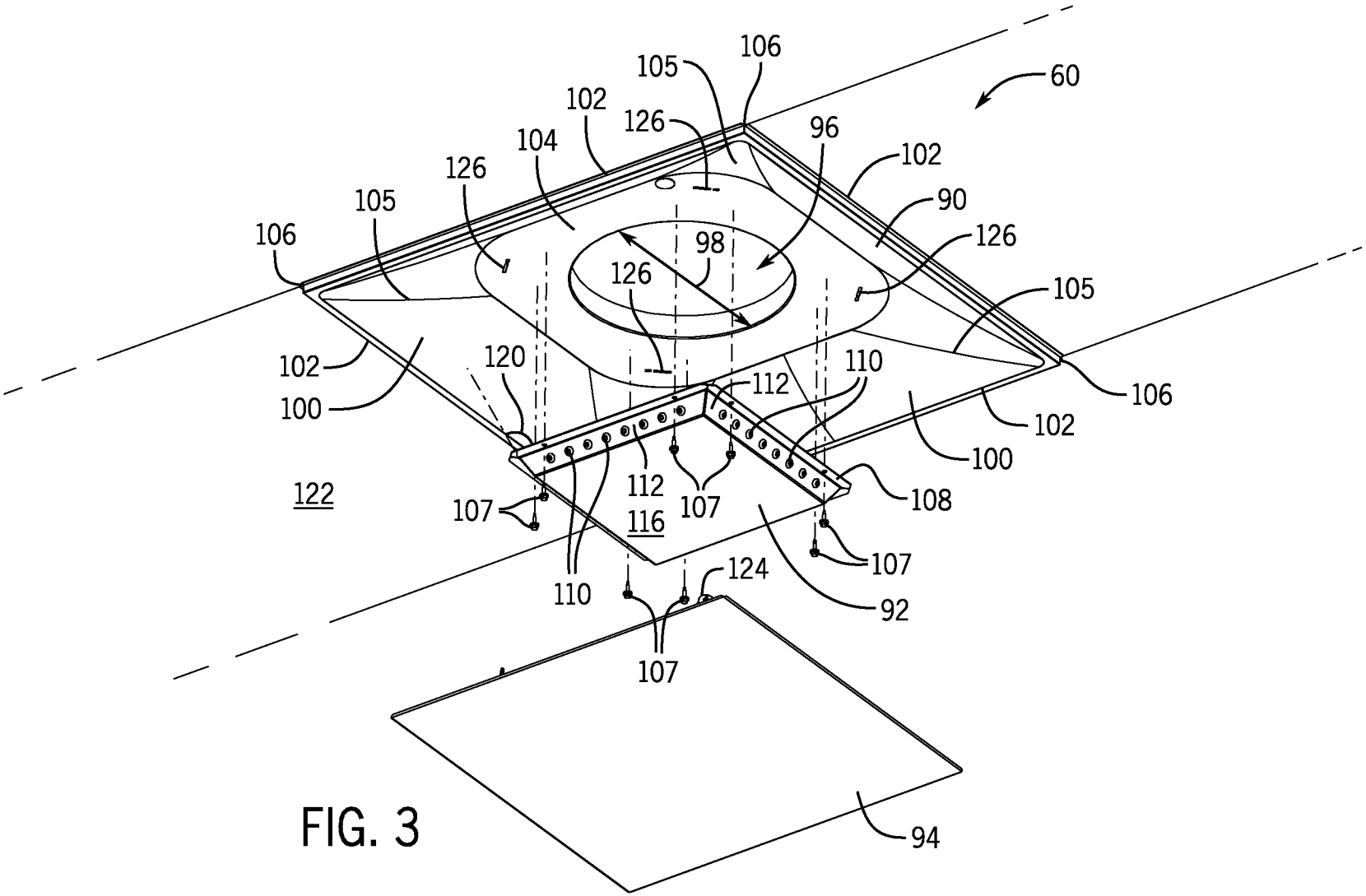
FIG. 3 is an exploded perspective view of an air diffuser having a low flow adapter, in accordance with an embodiment of the present disclosure.

For example, FIG. 3 is an exploded perspective view of the enhanced air diffuser 60. As shown in the illustrated embodiment of FIG. 3, the air diffuser 60 includes a mounting plate 90, a low flow adapter 92, and/or a diffusion plate 94. The mounting plate 90 may be coupled to the second end 72 of a respective secondary duct 68. For example, the mounting plate 90 may include an opening 96 that may be disposed over an outlet of the respective secondary duct 68 at the second end 72. For example, the opening 96 may include a diameter 98 (e.g., between 2 and 10 inches, between 5 and 9 inches, or between 4 and 8 inches) that may be greater than a diameter of the outlet of the respective secondary duct 68. Accordingly, the mounting plate 90 may be disposed over the outlet of the secondary duct 68. In some embodiments, the opening 96 of the mounting plate 90 may be sealed to the secondary duct 68 to form a substantially air-tight seal between the secondary duct 68 and the air diffuser 60. For example, the mounting plate 90 may be welded to the secondary duct 68 and/or secured to the secondary duct 68 using an adhesive, a fastener, a clamp, and/or another suitable device. In other embodiments, the diameter 98 may be less than or equal to the diameter of the outlet of the respective secondary duct 68. In such embodiments, the mounting plate 90 may be coupled to the secondary duct 68 using an intermediate component (e.g., a fitting that couples tubulars of different diameters).

In some embodiments, the mounting plate 90 may include recessed walls 100 (e.g., angled walls) that extend outward from edges 102 of the mounting plate 90. In some embodiments, the edges 102 may include a lip 103 (see e.g., FIGS. 5 and 6) that is configured to allow mounting in a narrow tee or tegular suspended ceiling grid module. Additionally, the edges 102 of the mounting plate 90 may be substantially flush with a ceiling of the interior space 74 (see e.g., FIG. 5). In some embodiments, the recessed walls 100 may extend into the ceiling and toward the secondary duct 68. Additionally, the recessed walls 100 may be coupled to a center portion 104 of the mounting plate 90, which may include the opening 96. Accordingly, the center portion 104 may be offset from, but substantially parallel to, the ceiling of the interior space 74. As used herein, the center portion 104 refers to the substantially planar structural portion of the mounting plate 90 extending between the recessed walls 100. While the present discussion focuses on the air diffuser 60 being mounted to the ceiling of the interior space 74, it should be recognized that the air diffuser 60 may be mounted to a wall, a floor, an exposed duct, and/or another suitable surface in the interior space 74.

In some embodiments, the recessed walls 100 may be tapered along edges 105 formed at corners 106 of the mounting plate 90. Tapering the recessed walls 100 of the mounting plate 90 may facilitate diffusion of the conditioned air as it flows from the low flow adapter 92 toward the interior space 74. For example, tapering the recessed walls 100 may reduce a resistance to the flow of the conditioned air caused by the recessed walls 100. Accordingly, the recessed walls 100 of the mounting plate 90 may enhance an efficiency of the air diffuser 60 by facilitating flow of the conditioned air into the interior space 74. In some embodiments, the mounting plate 90 may include a metallic material, such as steel and/or aluminum. In other embodiments, the mounting plate 90 may include another suitable material, such as a ferrous metal or plastic (e.g., a polymeric material).

The low flow adapter 92 may be coupled to the mounting plate 90 such that the low flow adapter 92 substantially covers the opening 96, thereby directing all or a portion of the conditioned air that flows from the respective secondary duct 68 through the low flow adapter 92. For example, in some embodiments, the low flow adapter 92 may be coupled to the mounting plate 90 by a plurality of fasteners 107. The fasteners 107 may extend through an outer edge 108 of the low flow adapter 92 and into the mounting plate 90. In some embodiments, the fasteners 107 may be secured to the mounting plate 90 by nuts and/or other securement devices (e.g., threaded openings in the mounting plate 90). When secured to the mounting plate 90, the outer edge 108 of the low flow adapter 92 may contact the center portion 104 of the mounting plate 90. In some embodiments, the outer edge 108 may be positioned substantially flush with the center portion 104 of the mounting plate 90.

As shown in the illustrated embodiment of FIG. 3, the low flow adapter 92 may include extruded nozzles 110 formed in sloped faces 112 of the low flow adapter 92. Accordingly, conditioned air may be directed from the opening 96 into a chamber 114 (see e.g., FIG. 6) between the center portion 104 and a base plate 116 of the low flow adapter 92. From the chamber 114, the conditioned air may flow through the extruded nozzles 110, which may increase a velocity (e.g., flow rate) of the conditioned air flowing toward the interior space 74. For example, as pressure builds in the chamber 114, the conditioned air may flow through the extruded nozzles 110. Because the extruded nozzles 110 include a reduced cross-sectional area as compared to the opening 96 and/or the chamber 114, the velocity of the conditioned air increases as the conditioned air flows through the extruded nozzles 110. The increased velocity of the conditioned air induces room air, thereby increasing a mass of the discharge isovel and enhancing dispersion of the conditioned air into the interior space 74 because the conditioned air may flow further away from the air diffuser 60 when compared to typical air diffusers. Accordingly, the air diffuser 60 enhances heating, cooling and/or ventilating when the conditioned air flows through the ductwork 36 at relatively low flow rates and/or volumes.

The sloped faces 112 may be coupled to both the outer edge 108 and the base plate 116, such that the low flow adapter 92 is substantially trapezoidal. However, in other embodiments, the low flow adapter 92 may include another suitable shape. As shown in the illustrated embodiment of FIG. 3, the sloped faces 112 of the low flow adapter 92 may extend from the outer edge 108 in a direction toward the interior space 74 and away from the opening 96. In some embodiments, the sloped faces 112 may extend from the outer edge 108 at an angle 120 with respect to a ceiling 122 of the interior space 74 (and the center portion 104 of the mounting plate 90). As discussed in detail below, the extruded nozzles 110 may direct the conditioned air into the interior space 74 at a second angle that may enhance diffusion of the conditioned air and enable the conditioned air to adhere to the ceiling surface.

In some embodiments, the low flow adapter 92 may be formed from a single piece of sheet material (e.g., steel sheet metal, aluminum sheet metal, and/or plastic). For example, the outer edge 108, the sloped faces 112, and/or the base plate 116 of the low flow adapter 92 may be formed by manipulating (e.g., bending) a single piece of sheet metal into a desired shape. In other embodiments, the low flow adapter 92 may be formed from an injection mold, and thus include a plastic material (e.g., a polymeric material). In still further embodiments, the low flow adapter 92 may be formed from multiple pieces of sheet metal (e.g., steel and/or aluminum) and/or other materials (e.g., polymeric materials). In any case, the extruded nozzles 110 may be formed in the sloped faces 112 of the low flow adapter 92 by a die (e.g., an angled die and/or a conical die) that extends through the sloped faces 112 of the low flow adapter 92. As shown in the illustrated embodiment of FIG. 3, the extruded nozzles 110 may each include a cross-section that is substantially circular. In other embodiments, one or more of the extruded nozzles 110 may include a cross-section that is oval-shaped, square-shaped, polygonal, and/or another suitable shape. Additionally, in some embodiments the extruded nozzles 110 may include the same cross-section shape. In other embodiments, the cross-section shape of the extruded nozzles 110 may be different from one another.

The diffusion plate 94 may be positioned below the low flow adapter 92 with respect to the ceiling 122 of the interior space 74, such that the low flow adapter 92 is positioned between the mounting plate 90 and the diffusion plate 94. In some embodiments, the diffusion plate 94 may be coupled to the mounting plate 90 using brackets 124 that extend into slots 126 of the mounting plate 90. The brackets 124 may be welded onto the diffusion plate 94 and/or otherwise secured to the diffusion plate 94. In other embodiments, the diffusion plate 94 may be secured to the mounting plate 90 using another suitable fastener (e.g., threaded bolts, screws, etc.). In still further embodiments, the diffusion plate 94 may be coupled to the low flow adapter 92 (e.g., via the base plate 116 and/or the outer edge 108). The diffusion plate 94 may include the same material as the mounting plate 90 and/or the low flow adapter 92. For example, the diffusion plate 94 may include steel, aluminum, and/or another suitable material (e.g., a polymeric material). In other embodiments, the diffusion plate 94 may include a material different from the mounting plate 90 and/or the low flow adapter 92.

In any case, the diffusion plate 94 may direct the flow of conditioned air toward the edges 102 of the mounting plate 90. By directing the flow of conditioned air toward the edges 102, the diffusion plate 94 may cause the conditioned air to adhere to the ceiling plane to engage in horizontal air flow, which may result in enhanced throw of the conditioned air into the interior space 74. Additionally or alternatively, the diffusion plate 94 may increase a radius of the flow of conditioned air into the interior space 74 than would otherwise occur without the diffusion plate 94. For example, without the diffusion plate 94, the flow of conditioned air may be directed immediately downward from the opening 96 and/or the low flow adapter 92 at a radius that is substantially the same size as the opening 96 and/or the low flow adapter 92. Accordingly, including the diffusion plate 94 spreads the flow of conditioned air, such that heating, cooling and/or ventilating the interior space 74 is performed with increased efficiency.

Figure 4:
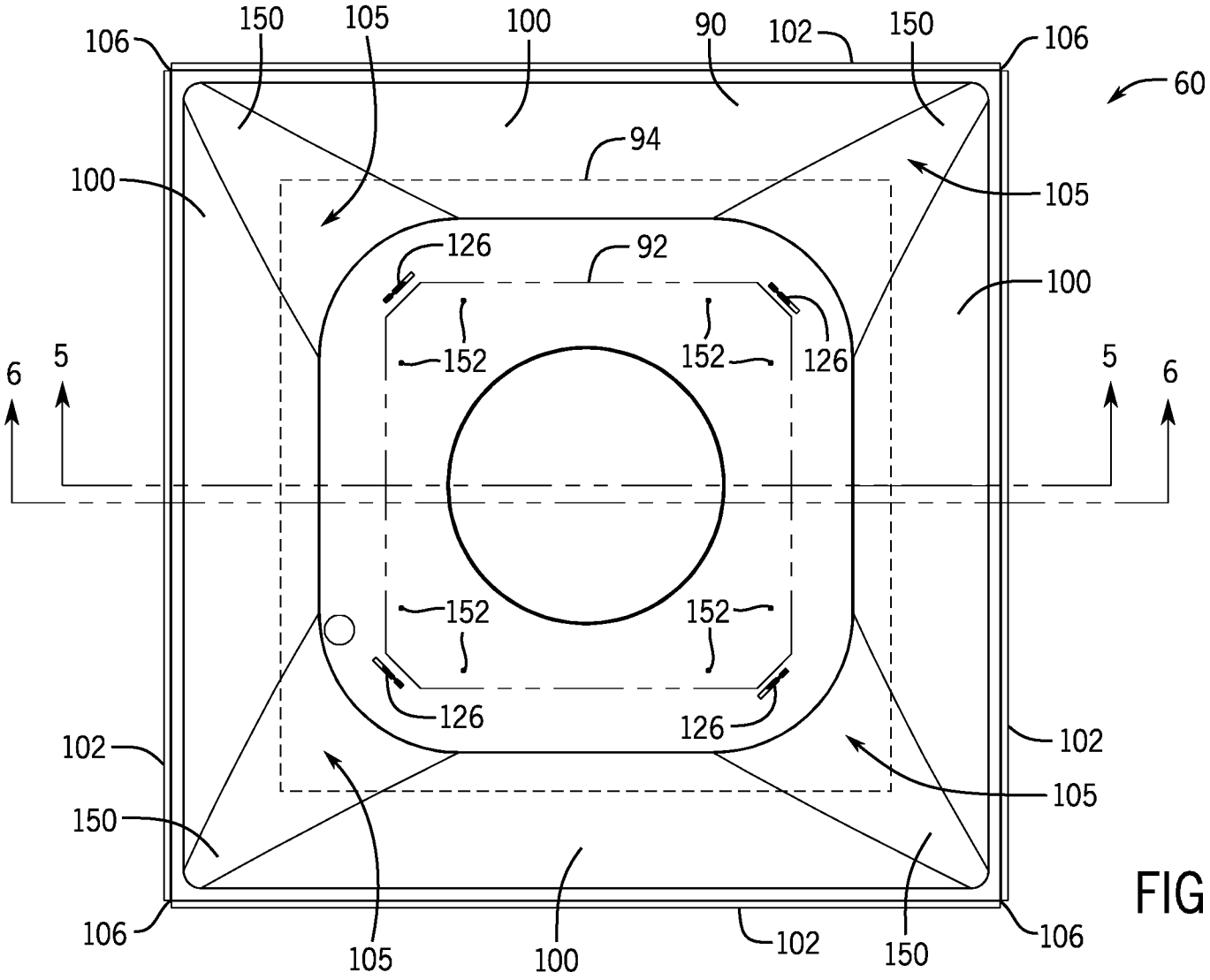
FIG. 4 is a plan view of the air diffuser of FIG. 3, in accordance with an embodiment of the present disclosure.

FIG. 4 is a plan view of the air diffuser 60 with the low flow adapter 92 and the diffusion plate 94 coupled to the mounting plate 90. In FIG. 4, the low flow adapter 92 and the diffusion plate 94 are transparent for clarity. As shown in the illustrated embodiment, the recessed walls 100 include tapered portions 150 along the edges 105 formed by the corners 106 of the mounting plate 90. As discussed above, the tapered portions 150 may reduce resistance caused by the mounting plate 90 to the conditioned air flowing into the interior space 74. Additionally, the tapered portions 150 may guide the conditioned air along a desired flow path into the interior space 74 (e.g., toward an opening in the air diffuser 60 as shown in FIGS. 5 and 6).

In the illustrated embodiment of FIG. 4, the mounting plate 90 includes apertures 152 configured to receive the fasteners 107 that secure the low flow adapter 92 to the mounting plate 90. In some embodiments, the apertures 152 may include threads that are configured to secure the fasteners 107 to the mounting plate 90. In other embodiments, the apertures 152 may extend through the mounting plate 90, such that nuts and/or other securement devices may couple the low flow adapter 92 to the mounting plate 90. As discussed above, the mounting plate 90 includes the slots 126 that are configured to receive the brackets 124 that couple the diffusion plate 94 to the mounting plate 90. In some embodiments, the slots 126 extend through the mounting plate 90. As such, the brackets 124 may extend through the mounting plate 90 and secure to the mounting plate 90 using a fastener (e.g., a hook) and/or an adhesive.

Figure 5:
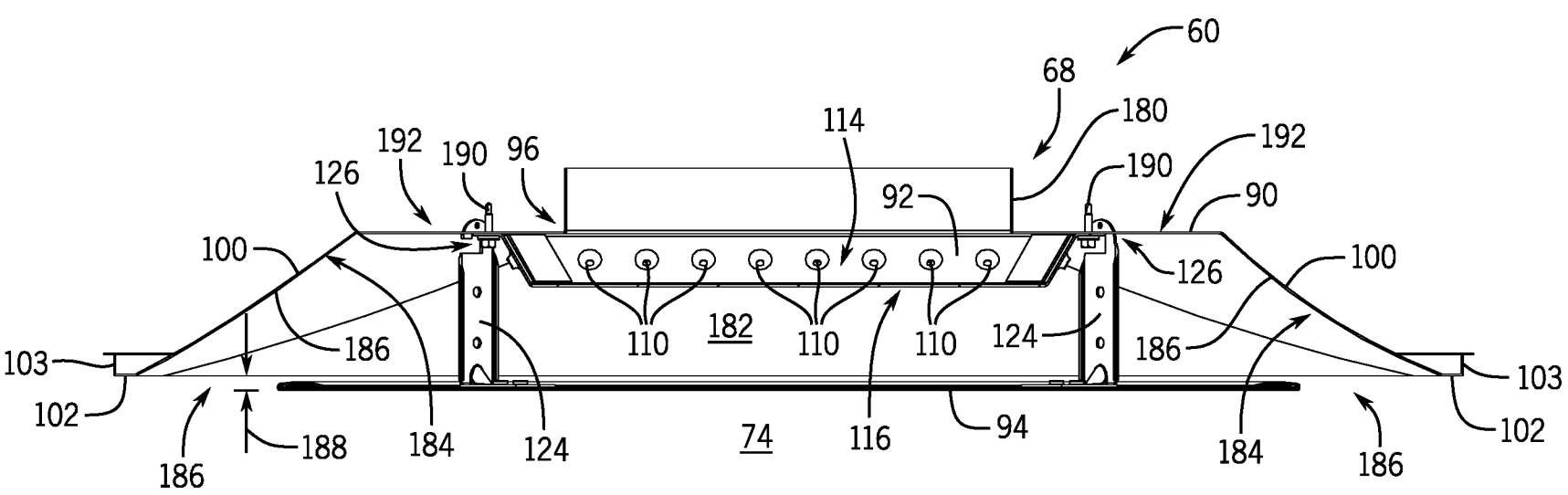
FIG. 5 is a partial cross-sectional side view of the air diffuser of FIG. 4 along line 5-5, in accordance with an embodiment of the present disclosure.
Figure 6:
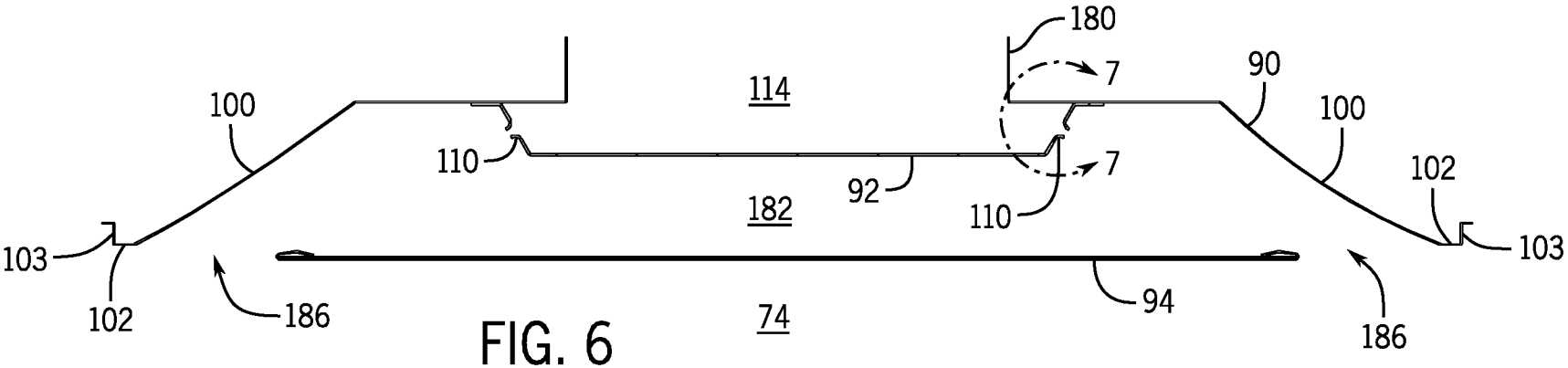
FIG. 6 is a cross-sectional schematic of the air diffuser of FIG. 4 along line 6-6, in accordance with an embodiment of the present disclosure.

FIG. 5 is a partial cross-section of the air diffuser 60 of FIG. 4 along the line 5-5. As shown in the illustrated embodiment of FIG. 5, the air diffuser is secured around an outlet 180 of the secondary duct 68. In some embodiments, the outlet 180 may extend into the opening 96 of the mounting plate 90 and be secured to the mounting plate 90 via a weld, a fastener (e.g., bolts, screws, clamps, etc.), an adhesive, and/or another securement device. Conditioned air may flow through the outlet 180 and into the chamber 114 between the mounting plate 90 and the base plate 116 of the low flow adapter 92. As pressure builds within the chamber 114, the conditioned air may flow out of the chamber 114 through the plurality of extruded nozzles 110. As discussed in detail below with reference to FIG. 6, the extruded nozzles 110 may be angled with respect to the center portion 104 of the mounting plate 90 and/or the diffusion plate 94 to further facilitate diffusion of the conditioned air into the interior space 74.

In any case, the conditioned air may be directed into a second chamber 182 formed between the mounting plate 90, the low flow adapter 92, and the diffusion plate 94. The conditioned air may be directed from the extruded nozzles toward the recessed walls 100 and/or the diffusion plate 94. In some embodiments, the recessed walls 100 include a contoured surface 184 that may facilitate the flow of the conditioned air in addition to the tapered portions 150. For example, the contoured surface 184 may include a curvature 186 that decreases a resistance caused by the recessed walls 100 on the flow of conditioned air, thereby increasing a flow of the conditioned air into the interior space 74.

The conditioned air may flow out of the second chamber 182 and into the interior space 74 through an opening 186 between the mounting plate 90 and the diffusion plate 94. In some embodiments, the diffusion plate 94 may be coupled to the mounting plate 90 so that the diffusion plate 94 extends beyond the mounting plate 90 by a distance 188. Accordingly, the opening 186 may direct the flow of conditioned air into the interior space 74 at an increased radius as the diffusion plate 94 and the recessed walls 100 enable the flow of air to disperse and spread out into the interior space 74. In other embodiments, the diffusion plate 94 may be coupled to the mounting plate 90 so that the diffusion plate 94 is flush with the edges 102 of the mounting plate 90. In still further embodiments, the diffusion plate may extend into the mounting plate 90. Additionally, the lip 103 may block the flow of conditioned air from flowing around the mounting plate 90 into the ceiling and/or away from the interior space 74.

As shown in the illustrated embodiment of FIG. 5, the diffusion plate 94 is coupled to the mounting plate 90 via the brackets 124 that extend through the slots 126 in the mounting plate 90. The brackets 124 include hooks 190 that are configured to secure the brackets 124 in the slots 126. For example, the hooks 190 may contact an outer surface 192 of the center portion 104 to block movement of the diffusion plate 94 with respect to the mounting plate 90. Additionally, the brackets 124 may be coupled to the diffusion plate 94 via a weld, a fastener, and/or an adhesive.

FIG. 6 is a cross-section of the diffusion plate 60 of FIG. 4 along the line 6-6. Additionally, FIG. 6 shows an expanded view of the extruded nozzle 110 in the low flow adapter 92. As shown in the illustrated embodiment of FIG. 6, the extruded nozzle 110 is at an angle with respect to horizontal plane defined by the center portion 104 of the mounting plate 90. For example, an axis 210 defining an opening 212 of the extruded nozzle 110 is at an angle 214 with respect to an axis 215 that is substantially parallel to the center portion 104 of the mounting plate 90. In some embodiments, the angle 214 may be between 16 and 50 degrees or between 30 and 40 degrees. In other embodiments, the angle 214 may be adjusted for desired performance and include any suitable angle. For example, the angle 214 may be approximately 40 degrees. In some embodiments, the angle 214 may not be 0 degrees, 90 degrees, 180 degrees, and/or 270 degrees. Forming the extruded nozzle at the angle 214 may enhance diffusion of the conditioned air into the interior space 74 because the conditioned air may be generally directed toward the opening 186 rather than toward the recessed walls 100 of the mounting plate 90. Accordingly, the conditioned air may flow to the opening 186 with reduced obstruction caused by the mounting plate 90 and/or the diffusion plate 92. Furthermore, while the disclosed embodiments of the openings 212 of the extruded nozzles 110 are described with reference to the angle 214 with respect to the axis 215 that is substantially parallel to the center portion 104 of the mounting plate 90, the openings 212 of the extruded nozzles 110 may also be described with reference to other angles. For example, the openings 212 of the extruded nozzles 110 may be disposed at an angle relative to a direction of flow of conditioned air passing through the outlet 180, which is generally perpendicular to the plane having the center portion 104 of the mounting plate 90. As such, the angle of the openings 212 relative to the direction of flow of conditioned air passing through the outlet 180 may be between 40 and 74 degrees or between 50 and 60 degrees.

Figure 7:
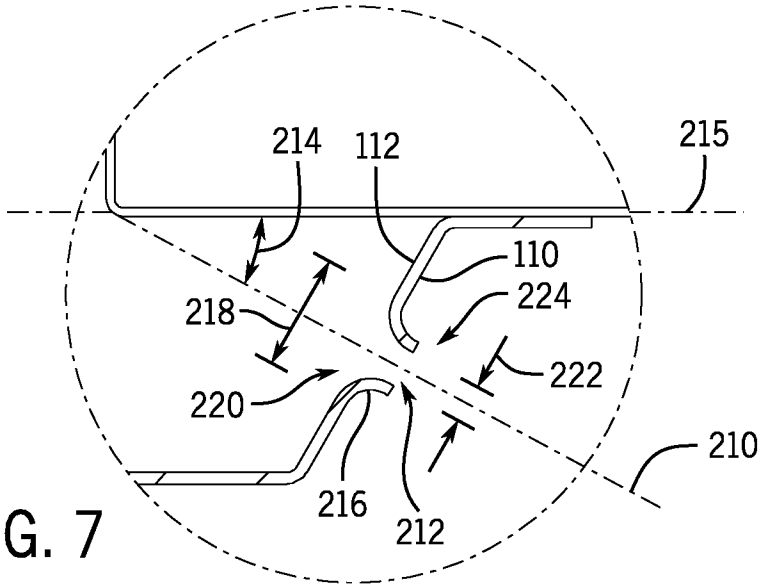
FIG. 7 is an expanded cross-sectional schematic of an extruded nozzle of the air diffuser of FIG. 6, in accordance with an embodiment of the present disclosure.

As discussed above, the extruded nozzles 110 may be formed in the sloped faces 112 using a die. For example, a die may pierce through the sloped faces 112 to create the extruded nozzles 110 (and the opening 212). As shown in the illustrated embodiment of FIG. 7, the extruded nozzles 110 each include a ridge 216 that is formed as a result of piercing the die through the sloped face 112. The ridge 216 may cause the extruded nozzle 110 to include a first diameter 218 at a first end 220 of the opening 212. Additionally, the ridge 216 may cause the extruded nozzle 110 include a second diameter 222 at a second end 224 of the opening 214, where the second diameter 222 is less than the first diameter 218. In this way, the openings 214 may be referred to as converging openings. Accordingly, the velocity of the conditioned air may increase as the conditioned air flows from the first end 220 of the opening 212 to the second end 224 of the opening 212. Increasing the velocity of the air from the first end 220 to the second end 224 may increase the induction of occupied air space into the conditioned air even when the conditioned air is supplied to the air diffuser 60 at relatively low flow rates (e.g., 20 cfm) and/or low volumes by providing an increased throw of conditioned air into the interior space 74. Therefore, dispersion of the conditioned air with existing air in the interior space 74 may be enhanced.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. An air diffuser, comprising:

a mounting plate comprising a center portion, a first opening formed in the center portion, and a wall extending from the center portion, wherein the air diffuser is configured to receive an air flow via the first opening;

a diffusion plate coupled to the mounting plate to form a second opening between the wall and the diffusion plate, wherein the air diffuser is configured to discharge the air flow via the second opening; and a flow adapter positioned between the mounting plate and the diffusion plate and coupled to the mounting plate across the first opening to facilitate receiving the air flow into the flow adapter, wherein the flow adapter comprises converging openings, and wherein each converging opening of the converging openings is disposed at an oblique angle with respect to the center portion of the mounting plate to direct the air flow from the flow adapter to the second opening with limited obstruction caused by the mounting plate and the diffusion plate.

2. The air diffuser of claim 1, wherein the flow adapter is coupled to the center portion of the mounting plate to define a chamber between the mounting plate and the flow adapter, and the chamber is configured to receive the air flow via the first opening and discharge the air flow via the converging openings.

3. The air diffuser of claim 2, wherein the flow adapter comprises a base plate and a face extending from the base plate to an outer edge of the flow adapter, the outer edge is mounted to the center portion of the mounting plate, and the converging openings are formed in the face.

4. The air diffuser of claim 3, wherein the flow adapter is formed from a single piece of material.

5. The air diffuser of claim 2, wherein each converging opening of the converging openings comprises a first end configured to receive the air flow from the chamber and a second end configured to discharge the air flow toward the second opening, the first end comprises a first aperture having a first cross-sectional area, the second end comprises a second aperture having a second cross-sectional area, and the second cross-sectional area is less than the first cross-sectional area.

6. The air diffuser of claim 5, wherein each converging opening of the converging openings comprises a nozzle, and wherein the first aperture and the second aperture are circular, oval-shaped, square-shaped, polygon-shaped, oblong-shaped, or any combination thereof.

7. The air diffuser of claim 1, wherein the mounting plate comprises a plurality of slots formed in the center portion, and the diffusion plate comprises a plurality of brackets configured to extend into the plurality of slots to couple the diffusion plate to the mounting plate.

8. The air diffuser of claim 7, wherein each bracket of the plurality of brackets comprises a hook configured to engage with the center portion of the mounting plate to couple the diffusion plate to the mounting plate.

9. An air diffuser configured to receive an air flow from ductwork, comprising:

a mounting plate comprising a center portion, a first opening formed in the center portion, and a wall coupled to the center portion and extending away from the center portion;

a flow adapter attached to the mounting plate across the first opening and forming a chamber between the flow adapter and the mounting plate, wherein the flow adapter comprises a base plate and a face extending from the base plate;

a plurality of converging openings formed through the face and extending away from the face, wherein each converging opening of the plurality of converging openings is disposed at an oblique angle relative to an axis extending parallel to the center portion; and a diffusion plate coupled to the mounting plate to form a second opening between one or more of first edges of the wall and second edges of the diffusion plate, wherein the second opening extends about at least a portion of a perimeter of the diffusion plate, and the air diffuser is configured to discharge the air flow via the second opening.

10. The air diffuser of claim 9, wherein the converging openings are configured to direct the air flow from the chamber toward the second opening to limit obstruction of the air flow caused by the wall and the diffusion plate.

11. The air diffuser of claim 9, wherein each converging opening defines an air passage extending from a first end of the converging opening to a second end of the converging opening, and the second end is offset from the respective face having the converging opening therethrough.

12. The air diffuser of claim 11, wherein the first end comprises a first diameter, the second end comprises a second diameter, and the second diameter is less than the first diameter such that the converging opening is configured to increase a velocity of the air flow directed through the converging opening.

13. The air diffuser of claim 9, wherein the oblique angle is between 30 degrees and 40 degrees.

14. The air diffuser of claim 9, wherein the diffusion plate is coupled to the mounting plate such that the diffusion plate is flush with the one of the first edges of the wall.

15. The air diffuser of claim 9, the air diffuser is configured to mount within a ceiling of a conditioned space such that the one of the first edges is flush with the ceiling.

16. A heating, ventilating, air conditioning, and refrigeration (HVAC&R) system, comprising:

ductwork configured to direct an air flow toward an interior space serviced by the HVAC&R system;

an air diffuser configured to receive the air flow from the ductwork and discharge the air flow into the interior space, comprising:

a mounting plate comprising a center portion and a wall extending from the center portion, wherein the center portion defines an opening fluidly coupled to the ductwork and configured to receive the air flow from the ductwork;

a diffusion plate coupled to the mounting plate to form an outlet of the air diffuser extending between the wall and the diffusion plate; and a flow adapter coupled to the mounting plate and covering the opening, wherein the flow adapter comprises:

a base plate extending parallel to the center portion;

a face extending from the base plate, wherein the base plate and the face at least partially define a chamber configured to receive the air flow from the opening; and a plurality of tubular nozzles formed in and extending away from the face, wherein the plurality of tubular nozzles is configured to direct the air flow from the chamber and toward the outlet between the wall and the diffusion plate with limited obstruction of the air flow caused by the mounting plate and the diffusion plate.

17. The HVAC&R system of claim 16, wherein the flow adapter is disposed between the mounting plate and the diffusion plate.

18. The HVAC&R system of claim 16, wherein the diffusion plate comprises hooks configured to engage with the mounting plate to couple the diffusion plate to the mounting plate.

19. The HVAC&R system of claim 16, wherein the wall comprises a tapered portion, a contoured surface, or both.

20. The HVAC&R system of claim 16, wherein each tubular nozzle of the plurality of tubular nozzles is disposed at an oblique angle with respect to center portion of the mounting plate.

* * * * *